US008346564B2

(12) United States Patent
Hotho et al.

(10) Patent No.: US 8,346,564 B2
(45) Date of Patent: Jan. 1, 2013

(54) MULTI-CHANNEL AUDIO CODING

(75) Inventors: Gerard Herman Hotho, Eindhoven (NL); Dirk Jeroen Breebaart, Eindhoven (NL); Erik Gosuinus Petrus Schuijers, Eindhoven (NL); Albertus Cornelis Den Brinker, Eindhoven (NL); Lars Falck Villemoes, Jarfalla (SE); Heiko Purnhagen, Sundbyberg (SE); Karl Jonas Roden, Solna (SE)

(73) Assignees: Koninklijke Philips Electronics N.V., Eindhoven (NL); Dolby International AB, Amsterdam Zuid-Oost (NL)

( * ) Notice: Subject to any disclaimer, the term of this patent is extended or adjusted under 35 U.S.C. 154(b) by 765 days.

(21) Appl. No.: 11/909,730

(22) PCT Filed: Mar. 16, 2006

(86) PCT No.: PCT/IB2006/050822

§ 371 (c)(1),
(2), (4) Date: Sep. 26, 2007

(87) PCT Pub. No.: WO2006/103584

PCT Pub. Date: Oct. 5, 2006

(65) Prior Publication Data

US 2010/0153097 A1 Jun. 17, 2010

(30) Foreign Application Priority Data

Mar. 30, 2005 (EP) ..... 05102515
Apr. 18, 2005 (EP) ..... 05103085

(51) Int. Cl.
*G10L 19/00* (2006.01)
*G10L 21/04* (2006.01)

(52) U.S. Cl. ..... 704/500; 704/501; 704/502; 704/503

(58) Field of Classification Search ..... 704/500, 704/501, 503–504, 263, 201
See application file for complete search history.

(56) References Cited

U.S. PATENT DOCUMENTS 6,205,430 B1 * 3/2001 Hui ..... 704/500

(Continued)

FOREIGN PATENT DOCUMENTS

RU 2047941 C1 11/1995

(Continued)

OTHER PUBLICATIONS

Breebart et al: "MPEG Spatial Audio Coding/MPEG Surround: Overview and Current Status"; Audio Engineering Society Convention Paper, New York, NY, US, Oct. 7, 2005, pp. 1-15, XP002364486.

(Continued)

*Primary Examiner* — Pierre-Louis Desir
*Assistant Examiner* — Abdelali Serrou
(74) *Attorney, Agent, or Firm* — Michael A. Glenn; Glenn Patent Group

(57) ABSTRACT

A multi-channel audio encoder (10) for encoding a multi-channel audio signal (101), e.g. a 5.1 channel audio signal, into a spatial down-mix (102), e.g. a stereo signal, and associated parameters (104, 105). The encoder (10) comprises first and second units (110, 120). The first unit (110) encodes the multi-channel audio signal (101) into the spatial down-mix (102) and parameters (104). These parameters (104) enable a multi-channel decoder (20) to reconstruct the multi-channel audio signal (203) from the spatial down-mix (102). The second unit (120) generates, from the spatial down-mix (102), parameters (105) that enable the decoder to reconstruct the spatial down-mix (202) from an alternative down-mix (103), e.g. a so-called artistic down-mix that has been manually mixed in a sound studio. In this way, the decoder (20) can efficiently deal with a situation in which an alternative down-mix (103) is received instead of the regular spatial, down-mix (102). In the decoder (20), first the spatial down-mix (202) is reconstructed from the alternative down-mix (103) and the parameters (105). Next, the spatial down-mix (202) is decoded into the multi-channel audio signal (203).

23 Claims, 4 Drawing Sheets

U.S. PATENT DOCUMENTS

Figure 1:
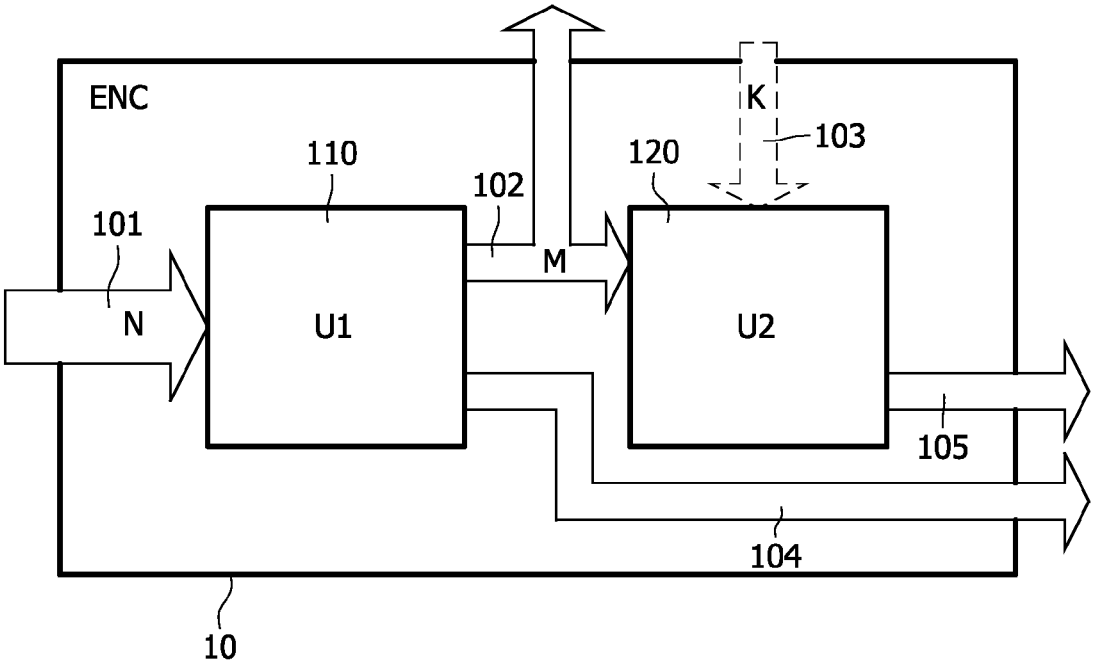

| | | | | |
|---|---|---|---|---|
| 6,341,165 | B1 * | 1/2002 | Gbur et al. | 381/23 |
| 6,694,027 | B1 | 2/2004 | Schneider | |
| 7,394,903 | B2 * | 7/2008 | Herre et al. | 381/23 |
| 7,447,317 | B2 * | 11/2008 | Herre et al. | 381/23 |
| 2003/0125933 | A1 * | 7/2003 | Saunders et al. | 704/201 |
| 2006/0009225 | A1 * | 1/2006 | Herre et al. | 455/450 |

FOREIGN PATENT DOCUMENTS

| | | | |
|---|---|---|---|
| RU | 2161868 | C1 | 1/2001 |
| WO | WO00/60746 | A2 | 10/2000 |
| WO | WO03/090208 | | 10/2003 |
| WO | WO2004008805 | A1 | 1/2004 |
| WO | WO2005101370 | A1 | 10/2005 |

OTHER PUBLICATIONS

Faller, C.: "Coding of Spatial Audio Compatible With Different Playback Formats"; Audio Engineering Society, Convention Paper, New York, NY, Oct. 28, 2004, pp. 1-12, XP002364728.

Herre et al: "MP3 Surround: Efficient and Compatible Coding of Multi-Channel Audio", Audio Engineering Society, Convention Preprint, XX,XX May 8, 2004, pp. 1-14, XP002338414.

Russian Decision to Grant, with English Translation, mailed Aug. 17, 2010, for related Russian Patent Application No. 2007139918/09(043706), 21 pages.

* cited by examiner

MULTI-CHANNEL AUDIO CODING

The invention relates to a multi-channel audio encoder for encoding N audio signals into M audio signals and associated parametric data, M and N being integers, N>M, M≧1.

The invention further relates to a multi-channel audio decoder, to a method of encoding a multi-channel audio signal, to a method of decoding a multi-channel audio signal, to an encoded multi-channel audio signal, to a storage medium having stored thereon such an encoded multi-channel audio signal, to a transmission system for transmitting and receiving an encoded multi-channel audio signal, to a transmitter for transmitting an encoded multi-channel audio signal, to a receiver for receiving an encoded multi-channel audio signal, to a method of transmitting and receiving an encoded multi-channel audio signal, to a method of transmitting an encoded multi-channel audio signal, to a method of receiving an encoded multi-channel audio signal, to a multi-channel audio player, to a multi-channel audio recorder and to a computer program product for executing any of the methods mentioned above.

Since some time multi-channel audio signal reproduction is gaining interest. A multi-channel audio signal is an audio signal having two or more audio channels. Well-known examples of multi-channel audio signals are two-channel stereo audio signals and 5.1 channel audio signals having two front audio channels, two rear audio channels, one centre audio signal and an additional low frequency enhancement (LFE) channel. Such 5.1 channel audio signals are used in DVD (Digital Versatile Disc) and SACD (Super Audio Compact Disc) systems. Because of the increasing popularity of multi-channel material, efficient coding of multi-channel material is becoming more important.

A 5.1-2-5.1 multi-channel audio coding system is known. In this known audio coding system a 5.1 input audio signal is encoded into and represented by two down-mix channels and associated parameters. The down-mix signals are also jointly referred to as spatial down-mix. In the known system, the spatial down-mix forms a stereo audio signal having a stereo image that is, as to quality, comparable to a fixed ITU down-mix from the 5.1 input channels. Users having only stereo equipment can listen to this spatial stereo down-mix, whilst listeners with 5.1 channel equipment can listen to the 5.1 channel reproduction that is made using this spatial stereo down-mix and the associated parameters. The 5.1 channel equipment decodes/reconstructs the 5.1 channel audio signal from the spatial stereo down-mix (i.e. the stereo audio signal) and the associated parameters.

However, studio engineers tend to find this spatial stereo down-mix rather dull. This is a reason for them to make an artistic stereo down-mix, which differs from the spatial stereo down-mix. For instance extra reverberation or sources are added, the stereo image is widened, etc. In order for users to be able to enjoy the artistic stereo down-mix this artistic down-mix, instead of the spatial down-mix, may be transmitted via a transmission medium or stored on a storage medium. This approach, however, seriously affects the quality of the 5.1 channel audio signal reproduction. The input 5.1 channel audio signal was encoded into a spatial stereo down-mix and associated parameters. By replacing the spatial stereo down-mix by the artistic stereo down-mix the spatial stereo down-mix is no longer available at the decoding end of the system and a high quality reconstruction of the 5.1 channel audio signal is not possible.

It is an object of the invention to provide a multi-channel audio encoder as described in the opening paragraph, in which the problem mentioned above is alleviated. This object is achieved in the multi-channel audio encoder according to the invention, wherein the multi-channel audio encoder comprises:

a first unit for encoding the N audio signals into the M audio signals and first associated parametric data, wherein the M audio signals and the first associated parametric data represent the N audio signals; and a second unit coupled to the first unit, the second unit being arranged for generating, from the M audio signals, second associated parametric data representing the M audio signals the second associated parametric data comprising modifications enabling a reconstruction of the M audio signals from K further audio signals being an alternative downmix of the N audio signals than the M audio signals, and wherein the associated parametric data comprise the first and second associated parametric data.

By generating from the spatial down-mix, i.e. the M audio signals, parameters representing the spatial down-mix a decoder will be able to reconstruct at least partly the spatial down-mix, e.g. by synthesising a signal resembling the spatial down-mix. These parameters, i.e. the second associated parametric data, represent the spatial down-mix, e.g. by means of one or more relevant properties of the spatial down-mix signal. The reconstructed spatial down-mix can thereafter be used with the first associated parametric data, i.e. the conventional multi-channel parameters, to decode and reconstruct the multi-channel audio signal, i.e. the N audio signals. The invention is based on the recognition that in this way a multi-channel audio signal having a better quality can be obtained than would be obtainable by using the alternative down-mix as basis for the decoding. Furthermore, in situations wherein the alternative down-mix is not available at the encoder or wherein the alternative down-mix is distorted a decoder can still use the parameters to reconstruct a multi-channel audio signal having a good quality.

The second unit is arranged for generating the second associated parametric data such that the second associated parametric data comprise modification parameters enabling a reconstruction of the M audio signals from K further audio signals. In this way, a decoder may perform an even better reconstruction of the spatial down-mix. This reconstruction may be done on basis of an alternative down-mix, i.e. the K further audio signals, such as an artistic down-mix. A decoder may apply the modification parameters to the alternative down-mix signal so that it more closely resembles the spatial down-mix.

In an embodiment of the multi-channel audio encoder according to the invention the second unit is arranged for generating, from the M audio signals and from the K further audio signals, the second associated parametric data such that the modification parameters represent a difference between the M audio signals and the K further audio signals. In this embodiment the alternative down-mix is available to the encoder and an efficient representation of the modification parameters can be made. By comparing the spatial down-mix with the alternative down-mix the second unit can generate modification parameters representing a difference between the spatial down-mix and the alternative down-mix. Such 'relative' modification parameters require less space/bits in the encoded multi-channel audio signal than the 'absolute' modification parameters of the previous embodiment. The alternative down-mix preferably is an artistic down-mix that is received by the multi-channel audio encoder from an external source. Alternatively, the alternative down-mix may be generated within the multi-channel audio encoder, e.g. from the N input audio signals.

The encoder may comprise a selector for selecting the alternative down-mix or the spatial down-mix for output. The selected down-mix will then be part of the encoded audio signal. The spatial down-mix may be selected e.g. when the alternative down-mix is not available.

In an embodiment of the multi-channel audio encoder according to the invention the second unit is arranged for generating the second associated parametric data such that the modification parameters comprise the property of the M audio signals or a difference between the property of the M audio signals and the property of the K further audio signals. The inventors have found that the modification parameters preferably comprise (a difference between) statistical signal properties such as variance, covariance and correlation and standard deviation of the down-mix signal(s). These statistical signal properties enable a good reconstruction of the spatial down-mix.

In an embodiment of the multi-channel audio encoder according to the invention the second unit is arranged for generating the second associated parametric data such that the property comprises:

an energy or power value of at least part of the audio signals; or a correlation value of at least part of the audio signals; or a ratio between energy or power values of at least part of the audio signals.

These properties alone or in any feasible combination enable an efficient and/or high quality reconstruction of the spatial down-mix. Energy or power values and correlation values enable a high quality reconstruction. A property comprising the ratio between energy or power values is efficient in that it only requires relatively little space/few bits in the encoded multi-channel audio signal/bit-stream.

The modification parameters are typically analyzed as a function of time and frequency (i.e. for a set of time/frequency tiles). They can be included in the parameter bit-stream that is included in the encoded multi-channel audio signal. In order to further improve the quality of the reconstruction of the spatial down-mix, it is possible to further extend the parameter bit stream with (encoded) low-frequency content of the spatial down-mix.

At the decoder, the modification parameters are obtained from the encoded multi-channel audio signal and the spatial down-mix is reconstructed using these parameters, either from the alternative down-mix or from scratch. The decoder transforms the alternative down-mix such that the resulting transformed down-mix signal has properties of the spatial down-mix. The decoder can operate in two ways, depending on the representation of the modification parameters. If the parameters represent the (relative) transformation from alternative down-mix to (required properties of the) spatial down-mix, the transformation variables are obtained directly from the transmitted parameters. On the other hand, if the transmitted parameters represent (absolute) properties of the spatial down-mix, the decoder first computes the corresponding properties of the alternative down-mix. Using this information (transmitted parameters and computed properties of the transmitted down-mix), the transformation variables are then determined that describe the transform from (properties of) the transmitted down-mix to (properties of) the spatial down-mix. Finally, the spatial parameters, i.e. the first associated parametric data, are applied to the reconstructed spatial down-mix in order to decode the multi-channel audio signal.

The same inventive concept may be used in a transmission system having a transmitter with a multi-channel audio encoder and a receiver with a multi-channel audio decoder. Such transmission systems may for example be used for transmission of speech signals or audio signals via a transmission medium such as a radio channel, a coaxial cable or an optical fibre. Such transmission systems can also be used for recording of encoded audio or speech signals on a recording medium such as a magnetic tape, magnetic or optical disc or solid-state memory. The inventive concept may also be used advantageously in an audio player/recorder, e.g. an optical disc audio player/recorder or a hard disk drive audio player/recorder or a solid-state memory audio player/recorder, having a multi-channel audio decoder/encoder.

Figure 2:
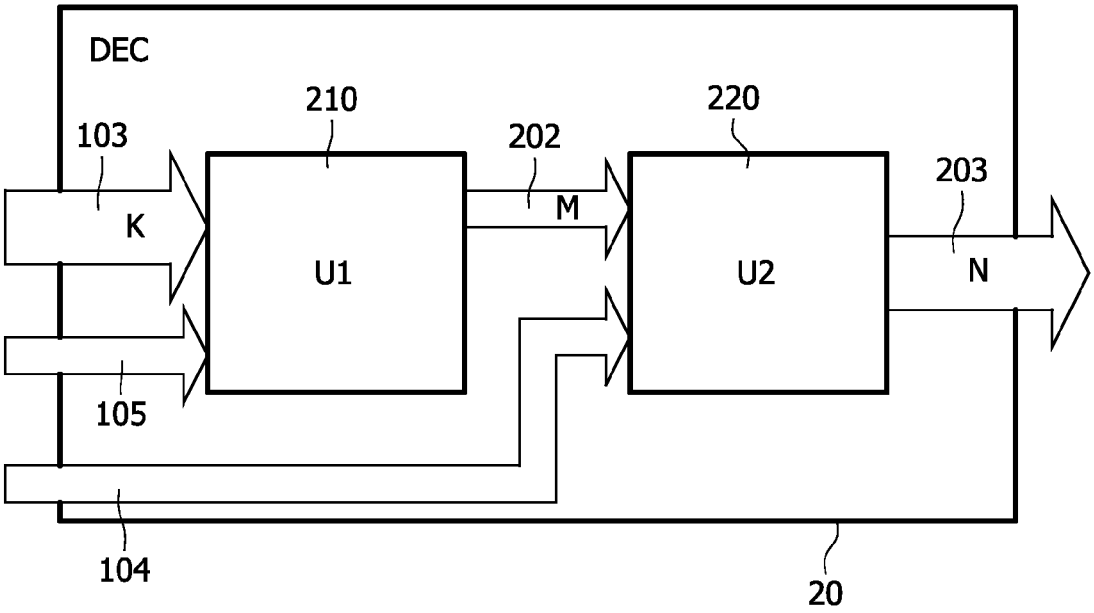
Figure 3:
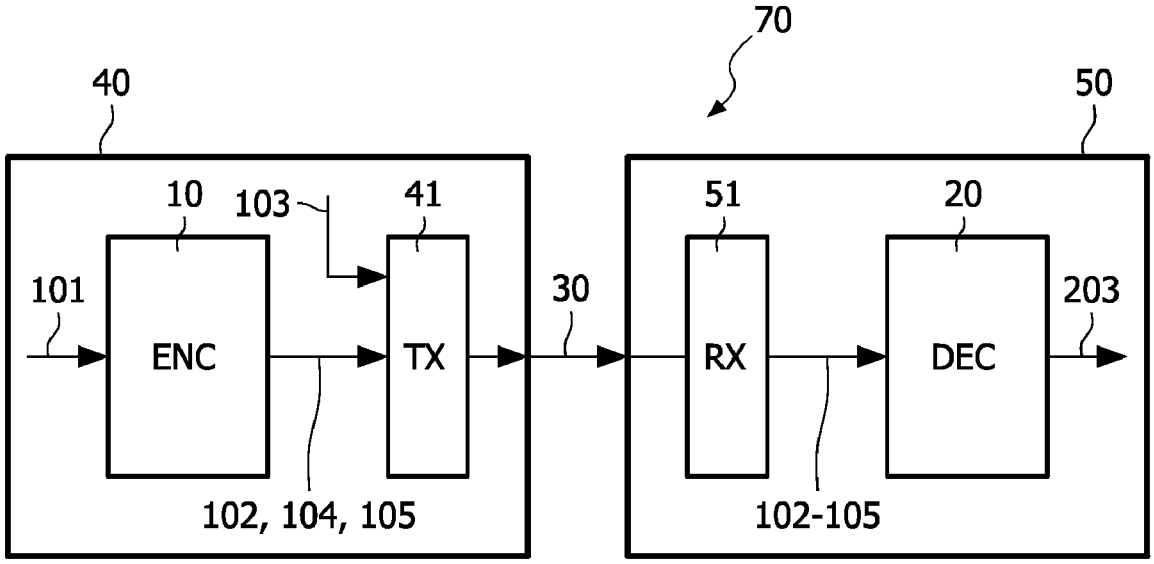
Figure 4:
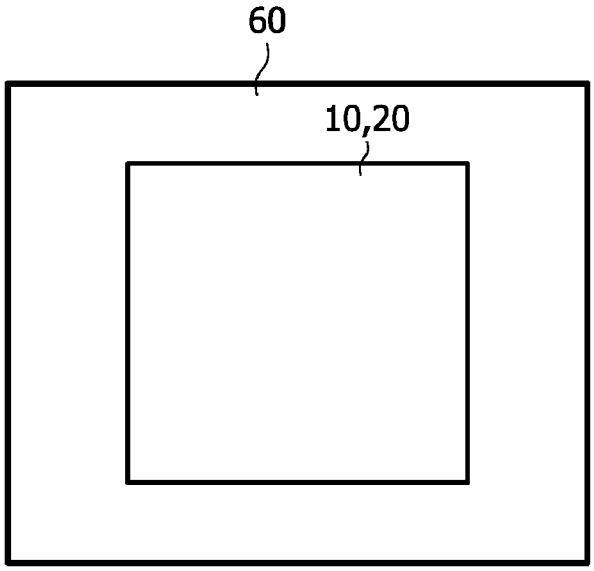
Figure 5:
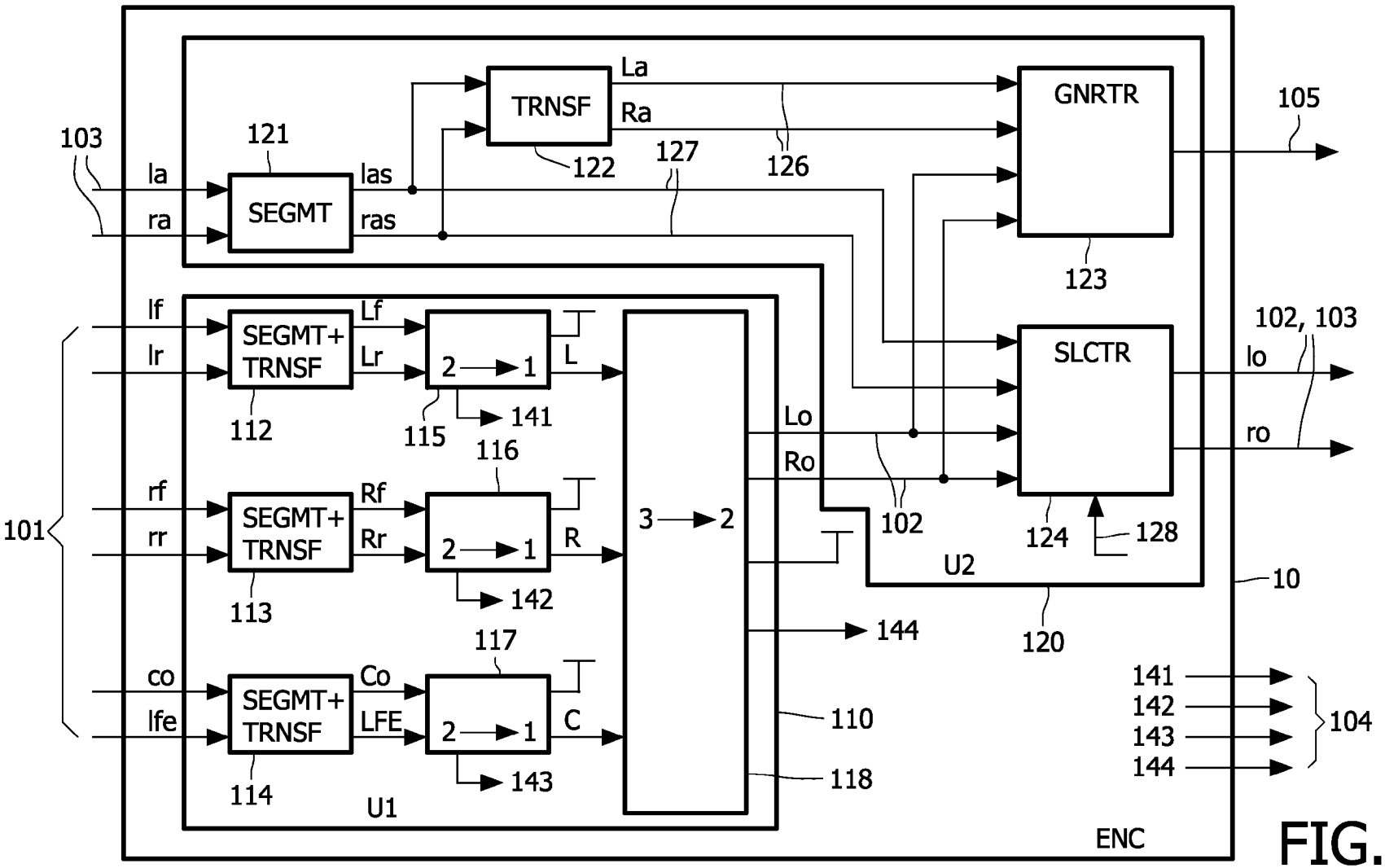
Figure 6:
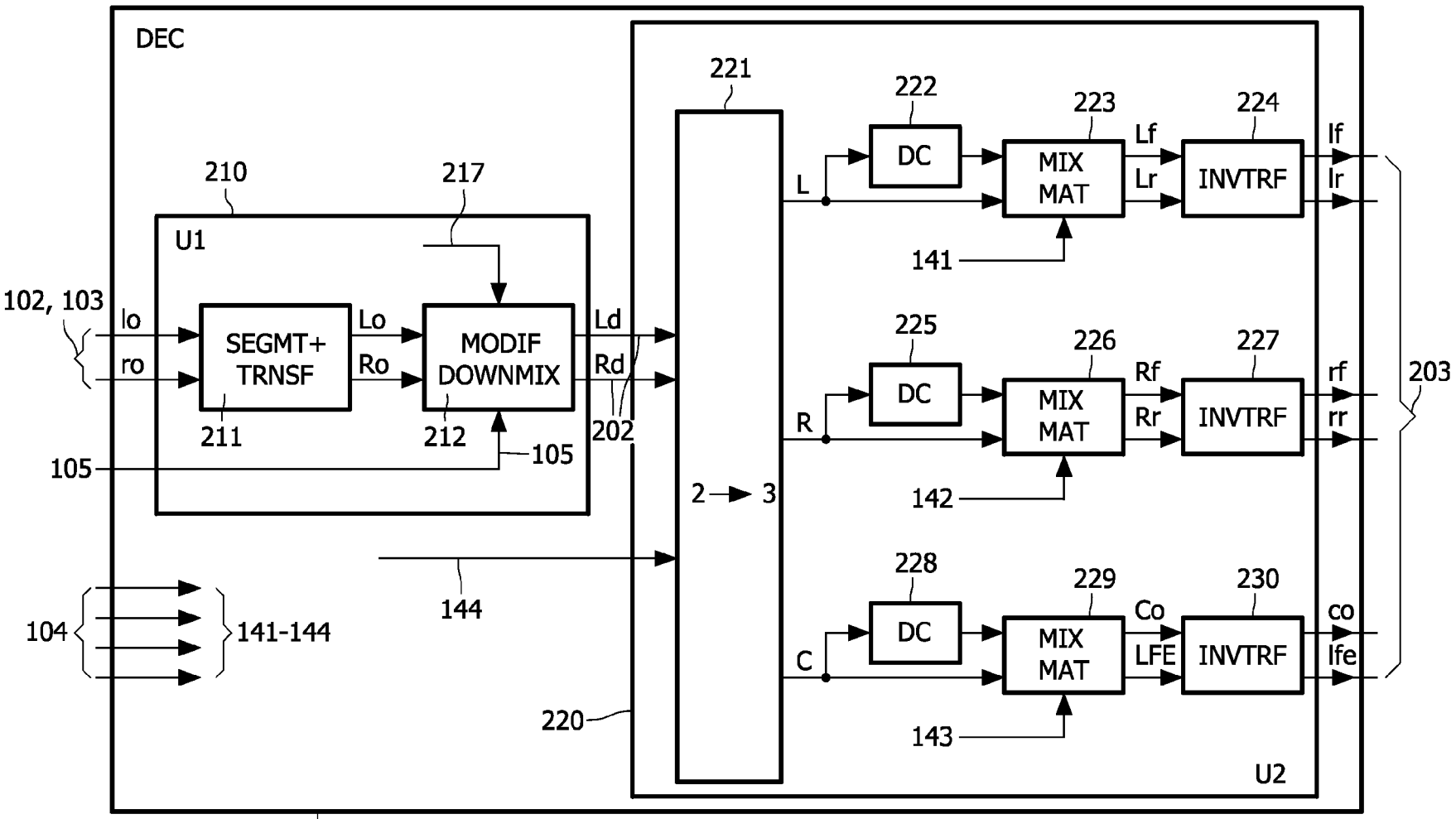

The above object and features of the present invention will be more apparent from the following description of the preferred embodiments with reference to the drawings, wherein:

FIG. 1 shows a block diagram of an embodiment of a multi-channel audio encoder 10 according to the invention, FIG. 2 shows a block diagram of an embodiment of a multi-channel audio decoder 20 according to the invention, FIG. 3 shows a block diagram of an embodiment of a transmission system 70 according to the invention, FIG. 4 shows a block diagram of an embodiment of a multi-channel audio player/recorder 60 according to the invention, FIG. 5 shows a block diagram of another embodiment of a multi-channel audio encoder 10 according to the invention, FIG. 6 shows a block diagram of another embodiment of a multi-channel audio decoder 20 according to the invention.

In the Figures, identical parts are provided with the same reference numbers.

FIG. 1 shows a block diagram of an embodiment of a multi-channel audio encoder 10 according to the invention. This multi-channel audio encoder 10 is arranged for encoding N audio signals 101 into M audio signals 102 and associated parametric data 104, 105. In this, M and N are integers, with $N>M$ and $M \geqq 1$. An example of the multi-channel audio encoder 10 is a 5.1-to-2 encoder in which N is equal to 6, i.e. 5+1 channels, and M is equal to 2. Such a multi-channel audio encoder encodes a 5.1 channel input audio signal into a 2 channel output audio signal, e.g. a stereo output audio signal, and associated parameters. Other examples of the multi-channel audio encoder 10 are 5.1-to-1, 6.1-to-2, 6.1-to-1, 7.1-to-2 and 7.1-to-1 encoders. Also encoders having other values for N and M are possible as long as N is larger than M and as long as M is larger than or equal to 1.

The encoder 10 comprises a first encoding unit 110 and coupled thereto a second encoding unit 120. The first encoding unit 110 receives the N input audio signals 101 and encodes the N audio signals 101 into the M audio signals 102 and first associated parametric data 104. The M audio signals 102 and the first associated parametric data 104 represent the N audio signals 101. The encoding of the N audio signals 101 into the M audio signals 102 as performed by the first unit 110 may also be referred to as down-mixing and the M audio signals 102 may also be referred to as spatial down-mix 102. The unit 110 may be a conventional parametric multi-channel audio encoder that encodes a multi-channel audio signal 101 into a mono or stereo down-mix audio signal 102 and associated parameters 104. The associated parameters 104 enable a decoder to reconstruct the multi-channel audio signal 101 from the mono or stereo down-mix audio signal 102. It is noted that the down-mix 102 may also have more than 2 channels.

The first unit 110 supplies the spatial down-mix 102 to the second unit 120. The second unit 120 generates, from the spatial down-mix 102, second associated parametric data 105. The second associated parametric data 105 represent the spatial down-mix 102, i.e. these parameters 105 comprise characteristics or properties of the spatial down-mix 102 which enable a decoder to reconstruct at least part of the spatial down-mix 102, e.g. by synthesizing a signal resembling the spatial down-mix 102. The associated parametric data comprise the first and second associated parametric data 104 and 105.

The second associated parametric data 105 may comprise modification parameters enabling a reconstruction of the spatial down-mix 102 from K further audio signals 103. In this way, a decoder may perform an even better reconstruction of the spatial down-mix 102. This reconstruction may be done on basis of an alternative down-mix 103, i.e. the K further audio signals 103, such as an artistic down-mix. A decoder may apply the modification parameters to the alternative down-mix signal 103 so that it more closely resembles the spatial down-mix 102.

The second unit 120 may receive at its inputs the alternative down-mix 103. The alternative down-mix 103 may be received from a source external to the encoder 10 (as shown in FIG. 1) or, alternatively, the alternative down-mix 103 may be generated inside the encoder 10 (not shown), e.g. from the N audio signals 101. The second unit 120 may compare the spatial down-mix 102 with the alternative down-mix 103 and generate modification parameters 105 representing a difference between the spatial down-mix 102 and the alternative down-mix 103, e.g. a difference between a property of the spatial down-mix 102 and a property of the alternative down-mix 103. Such 'relative' modification parameters representing this difference require less space/bits in the encoded multi-channel audio signal than 'absolute' modification parameters that only represent (one or more properties of) the spatial down-mix 102. The modification parameters 105 preferably comprise (a difference between) one or more statistical signal properties such as variance, covariance and correlation, or a ratio of these properties, of the (difference between the) down-mix signal(s). It is noted that the variance of a signal is equivalent with the energy or power of that signal. These statistical signal properties enable a good reconstruction of the spatial down-mix.

FIG. 2 shows a block diagram of an embodiment of a multi-channel audio decoder 20 according to the invention. The decoder 20 is arranged for decoding K audio signals 103 and associated parametric data 104, 105 into N audio signals 203. In this, K and N are integers, with N>K and K≧1. The K audio signals 103, i.e. the alternative down-mix 103, and the associated parametric data 104, 105 represent the N audio signals 203, i.e. the multi-channel audio signal 203. An example of the multi-channel audio decoder 20 is a 2-to-5.1 decoder in which N is equal to 6, i.e. 5+1 channels, and K is equal to 2. Such a multi-channel audio decoder decodes a 2 channel input audio signal, e.g. a stereo input audio signal, and associated parameters into a 5.1 channel output audio signal. Other examples of the multi-channel audio decoder 20 are 1-to-5.1, 2-to-6.1, 1-to-6.1, 2-to-7.1 and 1-to-7.1 decoders. Also decoders having other values for N and K are possible as long as N is larger than K and as long as K is larger than or equal to 1.

The multi-channel audio decoder 20 comprises a first unit 210 and coupled thereto a second unit 220. The first unit 210 receives the alternative down-mix 103 and modification parameters 105 and reconstructs M further audio signals 202, i.e. spatial down-mix 202 or an approximation thereof, from the alternative down-mix 103 and the modification parameters 105. In this, M is an integer, with M≧1. The modification parameters 105 represent the spatial down-mix 202. The second unit 220 receives the spatial down-mix 202 from the first unit 210 and modification parameters 104. The second unit 220 decodes the spatial down-mix 202 and modification parameters 104 into the multi-channel audio signal 203. The second unit 220 may be a conventional parametric multi-channel audio decoder that decodes a mono or stereo down-mix audio signal 202 and associated parameters 104 into a multi-channel audio signal 203.

The first unit 210 may be arranged for determining whether it is necessary or desirable to reconstruct the signal 202 from the input signal 103. Such reconstruction may not be applicable when the spatial down-mix signal 202 is supplied to the first unit 210 instead of the alternative down-mix 103. The first unit 210 can determine this by generating from the input signal 103 similar or same signal properties as are comprised in the modification parameters 105 and by comparing these generated signal properties with the modification parameters 105. If this comparison shows that the generated signal properties are equal to or substantially equal to the modification parameters 105 then the input signal 103 sufficiently resembles the spatial down-mix signal 202 and the first unit 210 can forward the input signal 103 to the second unit 220. If the comparison shows that the generated signal properties are not equal to or substantially equal to the modification parameters 105 then the input signal 103 does not sufficiently resemble the spatial down-mix signal 202 and the first unit 210 can reconstruct/approximate the spatial down-mix signal 202 from the input signal 103 and the modification parameters 105.

The modification parameters 105 may represent a difference between the alternative down-mix 103 and the spatial down-mix 202, e.g. a difference in statistical signal properties, enabling the first unit 210 to reconstruct the spatial down-mix 202 from the alternative down-mix 103.

The first unit 210 may generate, from the alternative down-mix, further modification parameters/properties representing the alternative down-mix 103. In such a case, the first unit 210 may reconstruct the spatial down-mix 202 from the alternative down-mix 103 and (a difference between) the modification parameters 105 and the further modification parameters.

The modification parameters 105 and the further modification parameters, respectively, may include statistical properties of the spatial down-mix 202 and the alternative down-mix 103, respectively. These statistical properties such as variance, correlation and covariance, etc. provide good representations of the signals they are derived from. They are useful in reconstructing the spatial down-mix 202, e.g. by transforming the alternative down-mix such that its associated properties match the properties comprised in the modification parameters 105.

FIG. 3 shows a block diagram of an embodiment of a transmission system 70 according to the invention. The transmission system 70 comprises a transmitter 40 for transmitting an encoded multi-channel audio signal via a transmission channel 30, e.g. a wired or wireless communication link, to a receiver 50. The transmitter 40 comprises a multi-channel audio encoder 10 as described above for encoding the multi-channel audio signal 101 into a spatial down-mix 102 and associated parameters 104, 105. The transmitter 40 further comprises means 41 for transmitting an encoded multi-channel audio signal comprising the parameters 104, 105 and the spatial down-mix 102 or the alternative down-mix 103 via the transmission channel 30 to the receiver 50. The receiver 50 comprises means 51 for receiving the encoded multi-channel audio signal and a multi-channel audio decoder 20 as described above for decoding the alternative down-mix 103 or the spatial down-mix 102 and the associated parameters 104, 105 into the multi-channel audio signal 203.

FIG. 4 shows a block diagram of an embodiment of a multi-channel audio player/recorder 60 according to the invention. The audio player/recorder 60 comprises a multi-channel audio decoder 20 and/or a multi-channel audio encoder 10 according to the invention. The audio player/recorder 60 can have its own storage for example solid-state memory or hard disk. The audio player/recorder 60 may also facilitate detachable storage means such as (recordable) DVD discs or (recordable) CD discs. Stored encoded multi-channel audio signals comprising an alternative down-mix 103 and parameters 104, 105 can be decoded by the decoder 20 and be played or reproduced by the audio player/recorder 60. The encoder 10 may encode multi-channel audio signals for storage on the storage means.

FIG. 5 shows a block diagram of another embodiment of a multi-channel audio encoder 10 according to the invention. The encoder 10 comprises a first unit 110 and coupled thereto a second unit 120. The first unit 110 receives a 5.1 multi-channel audio signal 101 comprising left front, left rear, right front, right rear, centre and low frequency enhancement audio signals lf, lr, rf, rr, co and lfe, respectively. The second unit 120 receives an artistic stereo down-mix 103 comprising left artistic and right artistic audio signals la and ra, respectively. The multi-channel audio signal 101 and the artistic down-mix 103 are time-domain audio signals. In the first and second units 110 and 120 these signals 101 and 103 are segmented and transformed to the frequency-time domain.

In the first unit 110, parametric data 104 is derived in three stages. In a first stage, three pairs of audio signals if and rf, rf and rr, and co and lfe, respectively, are segmented and the segmented signals are transformed to the frequency domain in segmentation and transformation units 112, 113, and 114, respectively. The resulting frequency domain representations of the segmented signals are shown as frequency domain signals Lf, Lr, Rf, Rr, Co and LFE, respectively. In a second stage, three pairs of these frequency domain signals Lf and Lr, Rf and Rr, and Co and LFE, respectively, are down-mixed in down-mixers 115, 116, and 117, respectively, to generate mono audio signals L, R, and C, respectively and associated parameters 141, 142, and 143, respectively. The down-mixers 115, 116, and 117 may be conventional MPEG4 parametric stereo encoders. Finally, in a third stage the three mono audio signals L, R and C are down-mixed in a down-mixer 118 to obtain a spatial stereo down-mix 102 and associated parameters 144. The spatial down-mix 102 comprises signals Lo and Ro.

The parametric data 141, 142, 143, and 144 are comprised in the first associated parametric data 104. The parametric data 104 and the spatial down-mix 102 represent the 5.1 input signals 101.

In the second unit, the artistic down-mix signal 103 represented in time domain by audio signals la and ra, respectively, is first segmented in segmentation unit 121. The resulting segmented audio signal 127 comprises signals las and ras, respectively. Next, this segmented audio signal 127 is transformed to the frequency domain by transformer 122. The resulting frequency domain signal 126 comprises signals La and Ra. Finally, the frequency domain signal 126, which is a frequency domain representation of the segmented artistic down-mix 103, and the frequency domain representation of the segmented spatial down-mix 102 are supplied to a generator 123 which generates modification parameters 105 which enable a decoder to modify/transform the artistic down-mix 103 so that it more closely resembles the spatial down-mix 102. The segmented time-domain signal 127 is also fed to a selector 124. The other two inputs to this selector 124 are the frequency domain representation of the spatial stereo down-mix 102 and a control signal 128. The control signal 128 determines whether the selector 124 is to output the artistic down-mix 103 or the spatial down-mix 102 as part of the encoded multi-channel audio signal. The spatial down-mix 102 may be selected when the artistic down-mix is not available. The control signal 128 can be manually set or can be automatically generated by sensing the presence of the artistic down-mix 103. The control signal 128 may be included in the parameter bit-stream so that a corresponding decoder 20 can make use of it as described later.

The output signal 102, 103 of the selector 124 is shown as signals lo and ro. If the artistic stereo down-mix 127 is to be output by the selector 124 the segmented time domain signals las and ras are combined in the selector 124 by overlap-add into signals lo and ro. If the spatial stereo down-mix 102 is to be output as indicated by the control signal 128, the selector 124 transforms the signals Lo and Ro back to the time domain and combines them via overlap-add into the signals lo and ro. The time-domain signals lo and ro form the stereo down-mix of the 5.1-to-2 encoder 10.

A more detailed description of the generator 123 is as follows. The function of the generator 123 is to determine modification parameters that describe a transformation of the artistic down-mix 103 so that it, in some sense, resembles the original spatial down-mix 102. In general, this transformation can be described as $$[\underline{L}_d \underline{R}_d] = [\underline{L}_a \underline{R}_a A_a \ldots A_N]T \quad (1)$$

wherein $\underline{L}_a$ and $\underline{R}_a$ are vectors comprising samples of a time/frequency tile of the left and right channel of the artistic down-mix 103, and wherein $\underline{L}_d$ and $\underline{R}_d$ are vectors comprising samples of a time/frequency tile of the left and right channel of the modified artistic down-mix, wherein $A_1, \ldots, A_N$ comprise the samples of a time/frequency tile of optional auxiliary channels, and wherein T is a transformation matrix. Note that any vector V is defined as a column vector. The modified artistic down-mix is the artistic down-mix 103 that is transformed by the transform so that it resembles the original spatial down-mix 102. The auxiliary channels $A_1, \ldots, A_N$ can for instance be de-correlated versions of the artistic down-mix signals or may contain low-frequency content of the spatial down-mix signals. In the latter case, this low-frequency content may be included in parameters 105. The (N+2)×2-transformation matrix T describes the transformation from the artistic down-mix 103 and the auxiliary channels to the modified artistic down-mix. The transformation matrix T or elements thereof are preferably comprised in the modification parameters 105 so that a decoder 20 can reconstruct at least part of the transformation matrix T. Thereafter, the decoder 20 can apply the transformation matrix T to the artistic down-mix 103 to reconstruct the spatial down-mix 102 (as described below).

Alternatively, the modification parameters 105 comprise signal properties, e.g. energy or power values and/or correlation values, of the spatial down-mix 102. The decoder 20 can then generate such signal properties from the artistic down-mix 103. The signal properties of the spatial down-mix 102 and the artistic down-mix 103 enable the decoder 20 to construct a transformation matrix T (described below) and to apply it to the artistic down-mix 103 to reconstruct the spatial down-mix 102 (also described below).

There are several possibilities to make the artistic stereo down-mix 103 resemble the original stereo down-mix 102:

I. Match of waveforms.

II. Match of statistical properties:

a. Match of the energy or power of the left and the right channel.

b. Match of the covariance matrix of the left and right channel.

III. Obtain the best possible match of the waveform under the constraint of an energy or power match of the left and the right channel.

IV. Mixing the above-mentioned methods I-III.

Below, the auxiliary channels $A_1, \ldots, A_N$ of (1) are not considered, so that the transformation matrix T can be written as $$[\underline{L}_d \underline{R}_d]=[\underline{L}_a \underline{R}_a]T \tag{2}$$

I. Waveform Match (Method I)

A match of the waveforms of the artistic down-mix 103 and the spatial down-mix 102 can be obtained by expressing both the left and the right signal of the modified artistic down-mix as a linear combination of the left and the right signal of the artistic stereo down-mix 103:

$$\underline{L}_d=\alpha_1\underline{L}_a+\beta_1\underline{R}_a,\ \underline{R}_d=\alpha_2\underline{L}_a+\beta_2\underline{R}_a. \tag{3}$$

Then, matrix T of (2) can be written as:

$$T=\begin{bmatrix}\alpha_1 & \alpha_2\\ \beta_1 & \beta_2\end{bmatrix}.$$

A way to choose the parameters $\alpha_1$, $\alpha_2$, $\beta_1$ and $\beta_2$, is to minimise the square of the Euclidian distance between the spatial down-mix signals $L_o$ and $R_o$ and their estimations (i.e. the modified artistic down-mix signals $L_d$ and $R_d$), hence $$\min_{\alpha_1,\beta_1}\sum_k \|L_0[k]-L_d[k]\|^2=\min_{\alpha_1,\beta_1}\sum_k \|L_0[k]-\alpha_1 L_a[k]-\beta_1 R_a[k]\|^2 \tag{4}$$

and $$\min_{\alpha_2,\beta_2}\sum_k \|R_0[k]-R_d[k]\|^2=\min_{\alpha_2,\beta_2}\sum_k \|R_0[k]-\alpha_2 L_a[k]-\beta_2 R_a[k]\|^2. \tag{5}$$

II. Match of Statistical Properties (Method II)

Method II.a: matching the energies of the left and the right signals is now discussed. The modified left and right artistic down-mix signal, denoted by $L_d$ and $R_d$ respectively, are now computed as $$\underline{L}_d=\alpha\underline{L}_a,\ \underline{R}_d=\beta\underline{R}_a, \tag{6}$$

where, in the case of real parameters, $\alpha$ and $\beta$ are given by $$\alpha=\sqrt{\frac{\sum_k \|L_0[k]\|^2}{\sum_k \|L_a[k]\|^2}},\quad \beta=\sqrt{\frac{\sum_k \|R_0[k]\|^2}{\sum_k \|R_a[k]\|^2}}, \tag{7}$$

so that the transformation matrix T can be written as $$T=\begin{bmatrix}\sqrt{\frac{\sum_k \|L_0[k]\|^2}{\sum_k \|L_a[k]\|^2}} & 0\\ 0 & \sqrt{\frac{\sum_k \|R_0[k]\|^2}{\sum_k \|R_a[k]\|^2}}\end{bmatrix}. \tag{8}$$

With these choices it can be ensured that the signals $L_d$ and $R_d$, respectively, have the same energy as the signals $L_o$ and $R_o$, respectively.

Method II.b: For matching the covariance matrices of the artistic stereo down-mix 103 and the spatial stereo down-mix 102 these matrices can be decomposed using eigenvalue decomposition as follows:

$$C_a=U_aS_aU_a^H,$$

$$C_0=U_0S_0U_0^H, \tag{9}$$

where the covariance matrix of the artistic stereo down-mix 103, $C_a$, is given by $$C_a=[\underline{L}_a\underline{R}_a]^H[\underline{L}_a\underline{R}_a]. \tag{10}$$

$U_a$ is a unitary matrix and $S_a$ is a diagonal matrix. $C_0$ is the covariance matrix of the spatial stereo down-mix 102, $U_o$ is a unitary matrix and $S_o$ is a diagonal matrix. When computing $$X_{aw}[\underline{L}_{aw}\underline{R}_{aw}]=[\underline{L}_a\underline{R}_a]U_aS_a^{-1/2}, \tag{11}$$

two mutually uncorrelated signals $\underline{L}_{aw}$ and $\underline{R}_{aw}$ are obtained (due to the multiplication with matrix $U_a$), which signals have unit energy (due to the multiplication with matrix $S_a^{-1/2}$). By computing $$X_d=[\underline{L}_d\underline{R}_d]=[\underline{L}_a\underline{R}_a]U_aS_a^{-1/2}U_rS_0^{1/2}U_0^H, \tag{12}$$

first the covariance matrix of $[\underline{L}_a\ \underline{R}_a]$ is transformed into a covariance matrix that equals the identity matrix, i.e. the covariance matrix of $[\underline{L}_a\ \underline{R}_a]U_aS_a^{-1/2}$. Applying any arbitrary unitary matrix $U_r$ will not change the covariance structure, and applying $S_0^{1/2}U_0^H$ results in a covariance structure equal to that of the spatial stereo down-mix 102.

Define the matrix $S_{0w}$ and the signals $\underline{L}_{0w}$ and $\underline{R}_{0w}$ as follows:

$$S_{0w}=[\underline{L}_{0w}\underline{R}_{0w}]=[\underline{L}_0\underline{R}_0]U_0S_0^{1/2}. \tag{13}$$

The matrix $U_r$ can be chosen such that the best possible waveform match, in terms of minimal squared Euclidian distance, is obtained between the signals $\underline{L}_{0w}$ and $\underline{L}_{aw}$ and the signals $\underline{R}_{0w}$ and $\underline{R}_{aw}$, where $\underline{L}_{aw}$ and $\underline{R}_{aw}$ are given by (11). With this choice for $U_r$, a waveform match within the statistical method can be used.

From (12) it can be seen that the transformation matrix T is given by $$T=U_aS_a^{-1/2}U_rS_0^{1/2}U_0^H. \tag{14}$$

III. Best Waveform Match Under an Energy Constraint (Method III)

Assuming (3) the parameters $\alpha_1$, $\alpha_2$, $\beta_1$ and $\beta_2$ can be obtained by minimising (4) and (5) under the energy constraints $$\sum_k \|L_0[k]\|^2=\sum_k \|L_d[k]\|^2,$$

$$\sum_k \|R_0[k]\|^2=\sum_k \|R_d[k]\|^2. \tag{15}$$

IV. Mixing Method (Method IV)

As to mixing the different methods, possible combinations are mixing methods II.a and II.b, or mixing methods II.a and III. One can proceed as follows:

a) If the waveform match between $\underline{L}_0$ and $\underline{L}_d$ and between $\underline{R}_0$ and $\underline{R}_d$ that is obtained when using method II.b/III is good: use method II.b/III.

b) If this waveform match is poor, use method II.a.

c) Ensure a gradual transition between the two methods, by mixing their transformation matrices, as a function of the quality of this waveform match.

This can be expressed mathematically as follows:

Using (3) and (2) the transformation matrix T can be written in its general form as $$T = \begin{bmatrix} \alpha_1 & \alpha_2 \\ \beta_1 & \beta_2 \end{bmatrix}. \tag{16}$$

This matrix is rewritten using two vectors, $\underline{T}_L$ and $\underline{T}_R$, as follows $$T = [\,\underline{T}_L \quad \underline{T}_R\,],\ \underline{T}_L = \begin{bmatrix} \alpha_1 \\ \beta_1 \end{bmatrix},\ \underline{T}_R = \begin{bmatrix} \alpha_2 \\ \beta_2 \end{bmatrix}. \tag{17}$$

The quality of the waveform match between $\underline{L}_0$ and $\underline{L}_d$ obtained by either using method II.b or method III, is expressed by $\gamma_L$. It is defined as $$\gamma_L = \max\left(0,\ \frac{\sum_k L_0[k]L_d^*[k]}{\sum_k \|L_0[k]\|\|L_d[k]\|}\right). \tag{18}$$

The quality of the waveform match between $\underline{R}_0$ and $\underline{R}_d$ obtained by either using method II.b or method III, is expressed by $\gamma_R$. It is defined as $$\gamma_R = \max\left(0,\ \frac{\sum_k R_0[k]R_d^*[k]}{\sum_k \|R_0[k]\|\|R_d[k]\|}\right). \tag{19}$$

Both $\gamma_L$ and $\gamma_R$ are between 0 and 1. The mixing coefficient of the left channel, $\delta_L$, and the mixing coefficient of the right channel, $\delta_R$, can be defined as follows:

$$\delta_L = \begin{cases} 1 & \gamma_L > \mu_{L,max} \\ 0 & \gamma_L < \mu_{L,min} \\ \frac{1}{2} - \frac{1}{2}\cos\left(\pi\frac{(\gamma_L - \mu_{L,min})}{(\mu_{L,max} - \mu_{L,min})}\right) & \text{else,} \end{cases} \tag{20}$$

$$\delta_R = \begin{cases} 1 & \gamma_R > \mu_{R,max} \\ 0 & \gamma_R < \mu_{R,min} \\ \frac{1}{2} - \frac{1}{2}\cos\left(\pi\frac{(\gamma_R - \mu_{R,min})}{(\mu_{R,max} - \mu_{R,min})}\right) & \text{else,} \end{cases}$$

wherein $\mu_{L,min}$, $\mu_{L,max}$, $\mu_{R,min}$ and $\mu_{R,max}$ are values between 0 and 1, $\mu_{L,min}<\mu_{L,max}$ and $\mu_{R,min}<\mu_{R,max}$. Equation (20) ensures that the mixing coefficients, $\delta_L$ and $\delta_R$, are between 0 and 1.

Define the transformation matrix T of method II.a, II.b and III, respectively, as $T_e$, which is given by (8), $T_a$, which is given by (14), and $T_{ce}$, respectively. Each transformation matrix can be split in two vectors, similar to the splitting of T in (17), as follows:

$$T_a[\underline{T}_{a,L}\underline{T}_{a,R}],\ T_e=[\underline{T}_{e,L}\underline{T}_{e,R}],\ T_{ce}=[\underline{T}_{ce,L}\underline{T}_{ce,R}]. \tag{21}$$

The transformation matrix T for mixing method II.a and method II.b is obtained as $$T=[\underline{T}_L\underline{T}_R]=[\delta_L\underline{T}_{a,L}+(1-\delta_L)\underline{T}_{e,L}\ \delta_R\underline{T}_{a,R}+(1-\delta_R)\underline{T}_{e,R}]. \tag{22}$$

The transformation matrix T for mixing method II.a and method III is obtained as $$T=[\underline{T}_L\underline{T}_R]=[\delta_L\underline{T}_{ce,L}+(1-\delta_L)\underline{T}_{e,L}\ \delta_R\underline{T}_{ce,R}+(1-\delta_R)\underline{T}_{e,R}]. \tag{23}$$

The elements of the transformation matrix T may be real-valued or complex-valued. These elements may be encoded into modification parameters as follows: those elements of the transformation matrix T that are real and positive can be quantised logarithmically, like the IID parameters used in MPEG4 Parametric Stereo. It is possible to set an upper limit for the values of the parameters to avoid over-amplification of small signals. This upper limit can be either fixed or a function of the correlation between the automatically generated left channel and the artistic left channel and the correlation between the automatically generated right channel and the artistic right channel. Of the elements of T that are complex, the magnitude can be quantised using IID parameters, and the phase can be quantised linearly. The elements of T are real and possibly negative can be coded by taking the logarithm of the absolute value of an element, whilst ensuring a distinction between the negative and positive values.

FIG. 6 shows a block diagram of another embodiment of a multi-channel audio decoder 20 according to the invention. The decoder 20 comprises a first unit 210 and coupled thereto a second unit 220. The first unit 210 receives down-mix signals lo and ro and modification parameters 105 as inputs. The down-mix signals lo and ro may be part of a spatial down-mix 102 or an artistic down-mix 103. The first unit 210 comprises a segmentation and transformation unit 211 and a down-mix modification unit 212. The down-mix signals lo and ro, respectively, are segmented and the segmented signals are transformed to the frequency domain in segmentation and transformation unit 211. The resulting frequency domain representations of the segmented down-mix signals are shown as frequency domain signals Lo and Ro, respectively. Next, the frequency domain signals Lo and Ro are processed in the down-mix modification unit 212. The function of this down-mix modification unit 212 is to modify the input down-mix such that it resembles the spatial down-mix 202, i.e. to reconstruct the spatial down-mix 202 from the artistic down-mix 103 and the modification parameters 105. If the spatial down-mix 102 is received by the decoder 20 the down-mix modification unit 212 does not have to modify the down-mix signals Lo and Ro and these down-mix signals Lo and Ro can simply be passed on to the second unit 220 as down-mix signals Ld and Rd of spatial down-mix 202. A control signal 217 may indicate whether there is a need for modification of the input down-mix, i.e. whether the input down-mix is a spatial down-mix or an alternative down-mix. The control signal 217 may be generated internally in the decoder 20, e.g. by analysing the input down-mix and the associated parameters 105 which may describe signal properties of the desired spatial down-mix. If the input down-mix matches the desired signal properties the control signal 217 may be set to indicate that there is no need for modification. Alternatively, the control signal 217 may be set manually or its setting may be received as part of the encoded multi-channel audio signal, e.g. in parameter set 105.

If the encoder 20 receives the artistic down-mix 103 and the control signal 217 indicates that the received down-mix signals Lo and Ro are to be modified by the down-mix modification unit 212 then the decoder can operate in two ways, depending on the representation of the transmitted parameters. If the parameters represent the (relative) transformation from transmitted down-mix to (required properties of the) spatial down-mix, the transformation variables are obtained directly from the transmitted parameters. With these transformation variables the transformation matrix T is directly composed.

On the other hand, if the transmitted parameters represent (absolute) properties of the spatial down-mix, the decoder first computes the corresponding properties of the actually transmitted down-mix. Using this information (transmitted parameters and computed properties of the transmitted down-mix), the transformation variables are then determined that describe the transform from (properties of) the transmitted down-mix to (properties of) the spatial down-mix. To be more specific, transformation matrix T can be determined using either method II.a or (a slightly modified) II.b that were previously described.

Method II.a is used if only (absolute) energies are transmitted in the parameter data. The transmitted (absolute) parameters, $E_{Lo}$ and $E_{Ro}$, represent the energy of the left and right signal of the spatial down-mix respectively and are given by $$E_{L_0} = \sum_k \|L_0[k]\|^2,\ E_{R_0} = \sum_k \|R_0[k]\|^2. \tag{24}$$

The energies of the transmitted down-mix, $E_{DLo}$ and $E_{DRo}$, are computed at the decoder. Using these variables we can compute the parameters α and β of (7), as follows $$\alpha = \sqrt{\frac{E_{L_0}}{E_{DL_0}}},\ \beta = \sqrt{\frac{E_{R_0}}{E_{DR_0}}}. \tag{25}$$

Transformation matrix T is given by $$T = \begin{bmatrix} \alpha & 0 \\ 0 & \beta \end{bmatrix}. \quad 26)$$

Method II.b is used if both (absolute) energies and (absolute) correlation are transmitted. The transmitted (absolute) energy parameters, $E_{Lo}$ and $E_{Ro}$, represent the energy of the left and right signal of the spatial down-mix respectively and are given by (24). These energies and the transmitted correlation between the left and the right signal of the spatial down-mix, $\rho_{LoRo}$, can be used to determine the covariance matrix of the spatial down-mix, $C_o$, as follows:

$$C_0 = \begin{bmatrix} E_{L_0} & \rho^*_{L_0R_0}\sqrt{E_{L_0}E_{R_0}} \\ \rho_{L_0R_0}\sqrt{E_{L_0}E_{R_0}} & E_{R_0} \end{bmatrix}. \tag{27}$$

The covariance matrix of the transmitted down-mix, $C_a$, is computed at the decoder. By applying eigenvalue analysis to both covariance matrices, as given by (9), we can compute the transformation matrix T using (14), except for the arbitrary unitary matrix $U_r$. Because the waveform of the spatial down-mix is not available, this matrix cannot be chosen as described previously. It can now e.g. be chosen such that transformation matrix T is as close as possible to a diagonal structure.

When auxiliary signals are used, they are also composed. If the received down-mix is not to be modified, the transformation matrix T is equal to the identity matrix and no auxiliary channels are used. Using equation (1), the output signals $\underline{L}_d$ and $\underline{R}_d$ are computed. It is noted that in the FIGS. 5 and 6 vectors like $\underline{L}_d$ and $\underline{R}_d$, respectively, are shown as Ld and Rd, respectively.

The second unit 220 is a conventional 2-to-5.1 multi-channel decoder which decodes the reconstructed spatial down-mix 202 and the associated parametric data 104 into a 5.1 channel output signal 203. As described before, the parametric data 104 comprise parametric data 141, 142, 143 and 144. The second unit 220 performs the inverse processing of the first unit 110 in the encoder 10. The second unit 220 comprises an up-mixer 221, which converts the stereo down-mix 202 and associated parameters 144 into three mono audio signals L, R and C. Next, each of the mono audio signals L, R and C, respectively, are de-correlated in de-correlators 222, 225 and 228, respectively. Thereafter, a mixing matrix 223 transforms the mono audio signal L, its de-correlated counterpart and associated parameters 141 into signals Lf and Lr. Similarly, a mixing matrix 226 transforms the mono audio signal R, its de-correlated counterpart and associated parameters 142 into signals Rf and Rr, and a mixing matrix 229 transforms the mono audio signal C, its de-correlated counterpart and associated parameters 143 into signals Co and LFE. Finally, the three pairs of segmented frequency-domain signals Lf and Lr, Rf and Rf, Co and LFE, respectively, are transformed to the time-domain and combined by overlap-add in inverse transformers 224, 227 and 230, respectively to obtain three pairs of output signals lf and lr, rf and rr, and co and lfe, respectively. The output signals lf, lr, rf, rr, co and lfe form the decoded multi-channel audio signal 203.

The multi-channel audio encoder 10 and the multi-channel audio decoder 20 may be implemented by means of digital hardware or by means of software which is executed by a digital signal processor or by a general purpose microprocessor.

The scope of the invention is not limited to the embodiments explicitly disclosed. The invention is embodied in each new characteristic and each combination of characteristics. Any reference signs do not limit the scope of the claims. The word "comprising" does not exclude the presence of other elements or steps than those listed in a claim. Use of the word "a" or "an" preceding an element does not exclude the presence of a plurality of such elements.

The invention claimed is:

1. A multi-channel audio encoder for encoding N audio signals into M audio signals and associated parametric data, M and N being integers, N>M, M≧1, wherein the multi-channel audio encoder comprises:

a first unit for encoding the N audio signals into the M audio signals and first associated parametric data, wherein the M audio signals and the first associated parametric data represent the N audio signals; and a second unit coupled to the first unit, the second unit being arranged for generating, from the M audio signals, second associated parametric data representing the M audio signals, the second associated parametric data comprising modification parameters enabling a reconstruction of the M audio signals from K further audio signals being an alternative downmix of the N audio signals than the M audio signals, and wherein the associated parametric data comprise the first and second associated parametric data, wherein K is equal to M and greater than 1, wherein the second unit is arranged for generating, from the M audio signals and from the K further audio signals, the second associated parametric data such that the modification parameters represent a difference between the M audio signals and the K further audio signals;

wherein at least one of the first unit and the second unit comprises a hardware implementation.

2. A multi-channel audio encoder according to claim 1, wherein the second unit is arranged for generating the second associated parametric data such that the second associated parametric data represent a property of the M audio signals.

3. A multi-channel audio encoder according to claim 1, wherein the second unit is arranged for generating the second associated parametric data such that the modification parameters comprise the property of the M audio signals or a difference between the property of the M audio signals and the property of the K further audio signals.

4. A multi-channel audio encoder according to claim 2, wherein the second unit is arranged for generating the second associated parametric data such that the property comprises:

an energy or power value of at least part of the audio signals; or a correlation value of at least part of the audio signals; or a ratio between energy or power values of at least part of the audio signals.

5. A multi-channel audio decoder for decoding K audio signals and associated parametric data into N audio signals, K and N being integers, N>K, K>1, wherein the K audio signals and the associated parametric data represent the N audio signals, and wherein the multi-channel audio decoder comprises:

a first unit for reconstructing M further audio signals from the K audio signals and at least a first part of the associated parametric data comprising modification parameters enabling a reconstruction of the M further audio signals from the K audio signals, the M further audio signals being an alternative down mix of the N audio channels than the K audio channels and M being an integer, M≧1, wherein the first part of the associated parametric data represents the M further audio signals, wherein K is equal to M and greater than 1, and wherein the modification parameters represent a difference between the M further audio signals and the K audio signals; and a second unit coupled to the first unit, the second unit being arranged for decoding the M further audio signals and at least a second part of the associated parametric data into the N audio signals, wherein the M further audio signals and the second part of the associated parametric data represent the N audio signals, wherein at least one of the first unit and the second unit comprises a hardware implementation.

6. A multi-channel audio decoder according to claim 5, wherein the first part of the associated parametric data represents a property of the M further audio signals.

7. A multi-channel audio decoder according to claim 5, wherein the modification parameters comprise the property of the M further audio signals or a difference between the property of the M further audio signals and the property of the K audio signals.

8. A multi-channel audio decoder according to claim 5, wherein the first unit is arranged for generating, from the K audio signals, further modification parameters representing the K audio signals, and wherein the first unit is further arranged for reconstructing the M further audio signals from the K audio signals and the modification parameters comprised in the first part of the associated parametric data and the further modification parameters.

9. A multi-channel audio decoder according to claim 8, wherein the modification parameters comprise the property of the M further audio signals, and wherein the further modification parameters comprise the property of the K audio signals, and wherein the first unit is arranged for reconstructing the M further audio signals from the K audio signals and a difference between the property of the M further audio signals and the property of the K audio signals.

10. A multi-channel audio decoder according to claim 6, wherein the property comprises:

an energy or power value of at least part of the audio signals; or a correlation value of at least part of the audio signals; or a ratio between energy or power values of at least part of the audio signals.

11. A method of encoding N audio signals into M audio signals and associated parametric data, M and N being integers, N>M, M≧1, wherein the method comprises:

encoding the N audio signals into the M audio signals and first associated parametric data, wherein the M audio signals and the first associated parametric data represent the N audio signals; and generating, from the M audio signals, second associated parametric data representing the M audio signals, the second associated parametric data comprising modification parameters enabling a reconstruction of the M audio signals from K further audio signals being an alternative downmix of the N audio signals than the M audio signals, wherein K is equal to M and greater than 1, and wherein the associated parametric data comprise the first and second associated parametric data, wherein, from the M audio signals and from the K further audio signals, the second associated parametric data are generated such that the modification parameters represent a difference between the M audio signals and the K further audio signals.

12. A method of decoding K audio signals and associated parametric data into N audio signals, K and N being integers, N>K, K>1, wherein the K audio signals and the associated parametric data represent the N audio signals, and wherein the method comprises:

reconstructing M further audio signals from the K audio signals and at least a first part of the associated parametric data comprising modification parameters enabling a reconstruction of the M further audio signals from the K audio signals, the M further audio signals being an alternative down mix of the N audio channels than the K audio channels and M being an integer, M≧1, wherein the first part of the associated parametric data represents the M further audio signals wherein K is equal to M and greater than 1, wherein the modification parameters represent a difference between the M further audio signals and the K audio signals; and decoding the M further audio signals and at least a second part of the associated parametric data into the N audio signals, wherein the M further audio signals and the second part of the associated parametric data represent the N audio signals.

13. A non-transitory computer storage medium having stored thereon an encoded multi-channel audio signal comprising K audio signals and associated parametric data, wherein the K audio signals and the associated parametric data represent N audio signals, K and N being integers, N>K, K≧1, and wherein the associated parametric data comprise first and second parts, wherein the first part of the associated parametric data represents M further audio signals and comprises modification parameters enabling a reconstruction of the M further audio signals from the K audio signals, the M further audio signals being an alternative down mix of the N audio channels than the K audio channels and M being an integer, M≧1, and wherein the M further audio signals and the second part of the associated parametric data represent the N audio signals, wherein K is equal to M and greater than 1, wherein, from the M audio signals and from the K further audio signals, the second associated parametric data are generated such that the modification parameters represent a difference between the M audio signals and the K further audio signals.

14. A transmission system comprising a transmitter for transmitting an encoded multi-channel audio signal via a transmission channel to a receiver, the transmitter comprising a multi-channel audio encoder according to claim 1 for encoding N audio signals into M audio signals and associated parametric data, the transmitter being configured to transmit the K further audio signals and the associated parametric data via the transmission channel to the receiver, the receiver being configured to receive the K further audio signals and the associated parametric data, the receiver further comprising a multi-channel audio decoder according to claim 7 for decoding the K further audio signals and the associated parametric data into the N audio signals, wherein, from the M audio signals and from the K further audio signals, the second associated parametric data are generated such that the modification parameters represent a difference between the M audio signals and the K further audio signals, wherein at least one of the transmitter, the receiver, the multi-channel audio encoder, the multi-channel decoder, and the means for receiving comprises a hardware implementation.

15. A transmitter for transmitting an encoded multi-channel audio signal, the transmitter comprising a multi-channel audio encoder according to claim 1 for encoding N audio signals into M audio signals and associated parametric data, the transmitter further comprising means for transmitting the K further audio signals and the associated parametric data.

16. A receiver for receiving an encoded multi-channel audio signal, the receiver comprising means for receiving K audio signals and associated parametric data, the receiver further comprising a multi-channel audio decoder according to claim 5 for decoding the K audio signals and the associated parametric data into N audio signals.

17. A method of transmitting and receiving an encoded multi-channel audio signal, the method comprising encoding N audio signals into M audio signals and associated parametric data, M and N being integers, N>M, M≧1, wherein the encoding comprises:

encoding the N audio signals into the M audio signals and first associated parametric data, wherein the M audio signals and the first associated parametric data represent the N audio signals; and generating, from the M audio signals, second associated parametric data representing the M audio signals, the second associated parametric data comprising modification parameters enabling a reconstruction of the M audio signals from K further audio signals being an alternative downmix of the N audio signals than the M audio signals, wherein the associated parametric data comprise the first and second associated parametric data, wherein K is equal to M and greater than 1, wherein, from the M audio signals and from the K further audio signals, the second associated parametric data are generated such that the modification parameters represent a difference between the M audio signals and the K further audio signals, the method further comprising transmitting and receiving the K audio signals and the associated parametric data, decoding the K audio signals and the associated parametric data into the N audio signals, the decoding comprising:

reconstructing M further audio signals from the K audio signals and at least a first part of the associated parametric data, wherein the first part of the associated parametric data represents the M further audio signals and comprises the modification parameters; and decoding the M further audio signals and at least a second part of the associated parametric data into the N audio signals, wherein the M further audio signals and the second part of the associated parametric data represent the N audio signals.

18. A method of transmitting an encoded multi-channel audio signal, the method comprising encoding N audio signals into M audio signals and associated parametric data, M and N being integers, N>M, M≧1, wherein the encoding comprises:

encoding the N audio signals into the M audio signals and first associated parametric data, wherein the M audio signals and the first associated parametric data represent the N audio signals; and generating, from the M audio signals, second associated parametric data representing the M audio signals, the second associated parametric data comprising modification parameters enabling a reconstruction of the M audio signals from K further audio signals being an alternative downmix of the N audio signals than the M audio signals, wherein the associated parametric data comprise the first and second associated parametric data, wherein K is equal to M and greater than 1, wherein, from the M audio signals and from the K further audio signals, the second associated parametric data are generated such that the modification parameters represent a difference between the M audio signals and the K further audio signals, the method further comprising transmitting the K further audio signals and the associated parametric data.

19. A method of receiving an encoded multi-channel audio signal, the method comprising receiving K audio signals and associated parametric data and decoding the K audio signals and the associated parametric data into N audio signals, K and N being integers, N>K, K>1, wherein the K audio signals and the associated parametric data represent the N audio signals, and wherein the decoding comprises:

reconstructing M further audio signals from the K audio signals and at least a first part of the associated parametric data comprising modification parameters enabling a reconstruction of the M further audio signals from the K audio signals, the M further audio signals being an alternative down mix of the N audio channels than the K audio channels and M being an integer, M≧1, wherein the first part of the associated parametric data represents the M further audio signals, wherein K is equal to M and greater than 1, and wherein the modification parameters represent a difference between the M further audio signals and the K audio signals; and decoding the M further audio signals and at least a second part of the associated parametric data into the N audio signals, wherein the M further audio signals and the second part of the associated parametric data represent the N audio signals.

20. A multi-channel audio player comprising a multi-channel audio decoder according to claim 5.

21. A multi-channel audio recorder comprising a multi-channel audio encoder according to claim 1.

22. A non-transitory computer storage medium having stored thereon a computer program product operative to cause a processor to perform the steps of the method as claimed in claim 11.

23. A non-transitory computer storage medium having stored thereon a computer program product operative to cause a processor to perform the steps of the method as claimed in claim 12.

* * * * *

UNITED STATES PATENT AND TRADEMARK OFFICE

CERTIFICATE OF CORRECTION

PATENT NO. : 8,346,564 B2
APPLICATION NO. : 11/909730
DATED : January 1, 2013
INVENTOR(S) : Hotho et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 891 days.

Signed and Sealed this
Eleventh Day of November, 2014

Michelle K. Lee

Michelle K. Lee
*Deputy Director of the United States Patent and Trademark Office*